US006244490B1

(12) United States Patent
Flannery et al.

(10) Patent No.: US 6,244,490 B1
(45) Date of Patent: Jun. 12, 2001

(54) REACTOR PLATE ASSEMBLY

(75) Inventors: Steven E. Flannery, Southborough, MA (US); William J. Cooper, Woonsocket, RI (US)

(73) Assignee: Avery Dennison Corporation, Pasadena, CA (US)

( * ) Notice: Subject to any disclaimer, the term of this patent is extended or adjusted under 35 U.S.C. 154(b) by 0 days.

(21) Appl. No.: 09/398,995

(22) Filed: Sep. 17, 1999

(51) Int. Cl.[7] ..... B65C 7/00
(52) U.S. Cl. ..... 227/67; 227/140
(58) Field of Search ..... 227/67, 71, 140, 227/156; 112/260; 15/192, 193, 176.4; 83/941

(56) References Cited

U.S. PATENT DOCUMENTS

| | | | | |
|---|---|---|---|---|
| 133,996 | * | 12/1872 | Lightenhome | 15/192 |
| 2,303,800 | * | 12/1942 | Swann | 15/192 |
| 2,326,811 | * | 8/1943 | Wiggam et al. | 15/193 |
| 2,778,043 | * | 1/1957 | Arf | 15/176.4 |
| 3,734,375 | | 5/1973 | Bone et al. . | |
| 4,039,078 | | 8/1977 | Bone . | |
| 5,092,829 | * | 3/1992 | Gerber | 227/67 |
| 5,189,936 | * | 3/1993 | Gerber et al. | 83/941 |
| 5,433,366 | | 7/1995 | Deschenes et al. . | |

* cited by examiner

*Primary Examiner*—Scott A. Smith
(74) *Attorney, Agent, or Firm*—Kriegsman & Kriegsman

(57) ABSTRACT

A reactor plate assembly which serves as an anvil for a plastic fastener dispensing device comprises a reactor plate and a brush assembly mounted on the reactor plate. The reactor plate includes a top surface, a bottom surface and an opening therethrough. The brush assembly includes a high density polyethylene mounting block having a top surface, a bottom surface and a recess formed in the top surface. The brush assembly also includes and a plurality of nylon brush filaments which are coupled to and extend out from the recess in the mounting block. The brush assembly is mounted on the bottom surface of the reactor plate by screws so that a portion of the plurality of filaments protrudes into the opening in said reactor plate with the free ends of plurality of filaments being flush with the top surface of the reactor plate.

8 Claims, 4 Drawing Sheets

REACTOR PLATE ASSEMBLY

BACKGROUND OF THE INVENTION

The present invention relates generally to devices for dispensing plastic fasteners and more particularly to a reactor plate assembly for a device for dispensing plastic fasteners.

In U.S. Pat. No. 4,039,078 to A.R. Bone, which is incorporated herein by reference, there are disclosed several different types of plastic fasteners, or attachments, which are fabricated as part of continuously connected ladder stock. In each instance, the fastener has an H-shape, and the ladder stock is formed from two elongated and continuous plastic side members coupled together by a plurality of plastic cross links, the cross links preferably being equidistantly spaced. The stock may be produced from flexible plastics material including nylon, polypropylene and other similar materials by molding or by stamping. Either manually or with the aid of specifically designed devices, individual fasteners may be dispensed from the ladder stock to couple buttons to fabric, merchandising tags to articles of commerce, or, in general, any two desired articles. In those instances where the dispensing device has dual needles, the attachments severed from the stock can be used like staples to secure objects and items.

Devices for dispensing plastic fasteners are well known in the art. Plastic fastener dispensing devices are commonly used to sever individual plastic fasteners from continuously connected ladder stock and to attach such individual plastic fasteners to items, such as socks. Devices for dispensing plastic fasteners often comprise a frame which includes a base, a neck, a housing, and an arm onto which a reactor plate is mounted. Devices for dispensing plastic fasteners also typically comprise a hollow slotted needle which is mounted onto a head member that can be downwardly displaced by a crank arm.

The reactor plate for the device serves as a support surface, or anvil, on which the items to be coupled by a plastic fastener are placed. The reactor plate typically includes a top surface, a bottom surface and an opening formed in the top surface. The opening is typically circular in lateral cross-section and is relatively small in size (approximately 0.25 inches in diameter).

In use, the items to be attached by a plastic fastener are placed on the reactor plate. Activation of the crank arm drives the hollow slotted needle down through the items to be attached and into the opening formed in the top surface of the reactor plate. With the needle disposed through the items and into the opening in the reactor plate, further activation of the crank arm downwardly projects an ejector rod which is disposed inside the hollow needle. Downward projection of the ejector rod urges a cross-bar of the plastic fastener through the articles to be coupled.

In U.S. Pat. No. 5,433,366 to C. L. Deschenes, which is incorporated herein by reference, there is disclosed a device for dispensing plastic attachments of the type which are formed as part of a roll of continuously connected ladder stock. In one embodiment, the device includes a pair of hollow slotted needles each having a tip, a rear end and a longitudinal axis. A feed wheel, placed proximate to the rear ends of the pair of needles, is used to feed individual attachments of a roll of ladder stock into the pair of needles through their respective rear ends at angles relative to the longitudinal axes thereof. Once inserted into the needles, an attachment is severed from the remainder of the ladder stock by a knife and is then expelled from the needles by a pair of ejector rods movable along the longitudinal axes of the pair of needles. Because attachments are fed into the pair of needles at angles relative to their longitudinal axes, no shuttling of the needles between an attachment feeding position and an attachment ejecting position is required. The pair of needles, the feed wheel, the knife, and the pair of ejector rods are all mounted on a vertically movable head member. An electric motor assembly is used to move the head member between an attachment dispensing position and a withdrawal position. The vertical movement of the head member drives the operation of the feed wheel, the knife and the ejector rods.

Although devices of the type described above have performed reasonably well in dispensing plastic fasteners, it has been found that these types of devices often experience two notable drawbacks.

As a first drawback, it has been found that, on occasion, the reactor plate provides inadequate support for coupling together the desired articles. In particular, it has been found that, as the needle pierces through the items during the coupling process, articles which are manufactured out of a thin material are often pushed down into the opening in the reactor plate. As a result, the needle is unable to pierce all the way through the items, thereby preventing the device from properly coupling the desired articles with a plastic fastener.

As a second drawback, it has been found that, on occasion, the needle does not properly align itself down into the opening formed in the reactor plate. Specifically, as the needle is displaced downward through the items, the fabric, or weave, of the items often bends, or attenuates the needle, thereby displacing the needle laterally. As a consequence, the needle is often misaligned and, accordingly, will abut against the top surface of the reactor plate rather than project down into the relatively small opening in the reactor plate, thereby preventing the device from properly coupling the desired articles with a plastic fastener.

SUMMARY OF THE INVENTION

It is an object of this invention to provide a new and improved reactor plate assembly for a device for dispensing plastic fasteners.

It is another object of this invention to provide a reactor plate assembly as described above which provides proper support for articles which are to be coupled by a plastic fastener dispensed by the device.

It is yet another object of this invention to provide a reactor plate assembly which enables a hollow needle for the device for dispensing plastic fasteners to project through the articles to be coupled by the plastic fastener.

It is still another object of this invention to provide a reactor plate assembly which has a limited number of parts, which is easy to use and which is inexpensive to manufacture.

Accordingly, as one feature of the present invention, there is provided a reactor plate assembly for a device for dispensing plastic fasteners, the reactor plate assembly comprising a reactor plate having a top surface, a bottom surface and an opening therethrough, and a brush assembly mounted on said reactor plate.

As another feature of the present invention, there is provided a brush assembly for a device for dispensing plastic fasteners, the brush assembly comprising a mounting block having a top surface and a bottom surface, and a plurality of brush filaments coupled to and extending out from said mounting block.

Various other features and advantages will appear from the description to follow. In the description, reference is made to the accompanying drawings which form a part thereof, and in which is shown by way of illustration, a specific embodiment for practicing the invention. This embodiment will be described in sufficient detail to enable those skilled in the art to practice the invention, and it is to be understood that other embodiments may be utilized and that structural changes may be made without departing from the scope of the invention. The following detailed description is therefore, not to be taken in a limiting sense, and the scope of the present invention is best defined by the appended claims.

BRIEF DESCRIPTION OF THE DRAWINGS

In the drawings wherein like reference numerals represent like parts.

DETAILED DESCRIPTION OF THE PREFERRED EMBODIMENT

Figure 1:
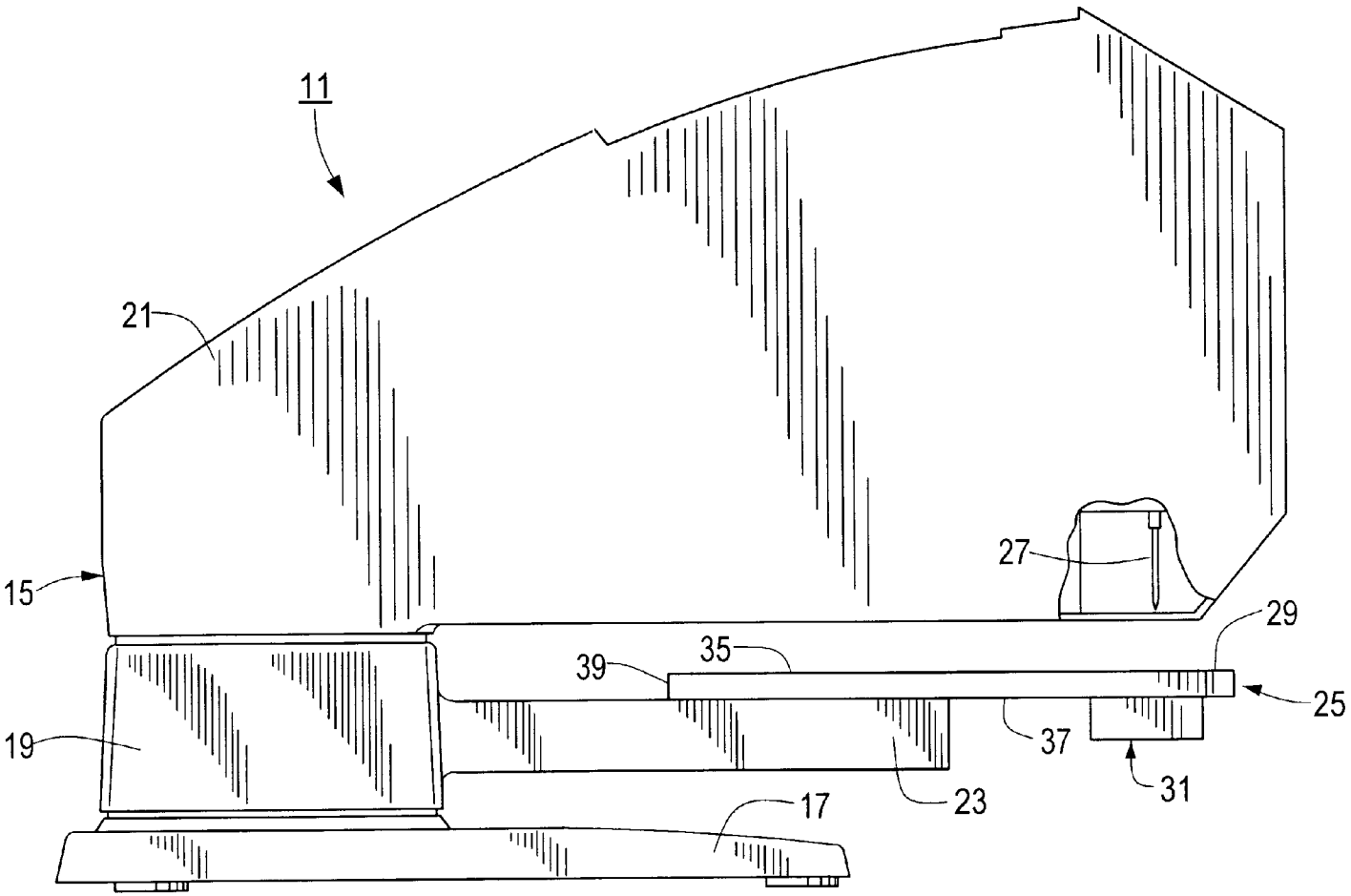
FIG. 1 is a side view of a device for dispensing fasteners constructed according to the teachings of the present invention, the housing being shown broken away in part to reveal the hollow slotted needle.
Figure 3:
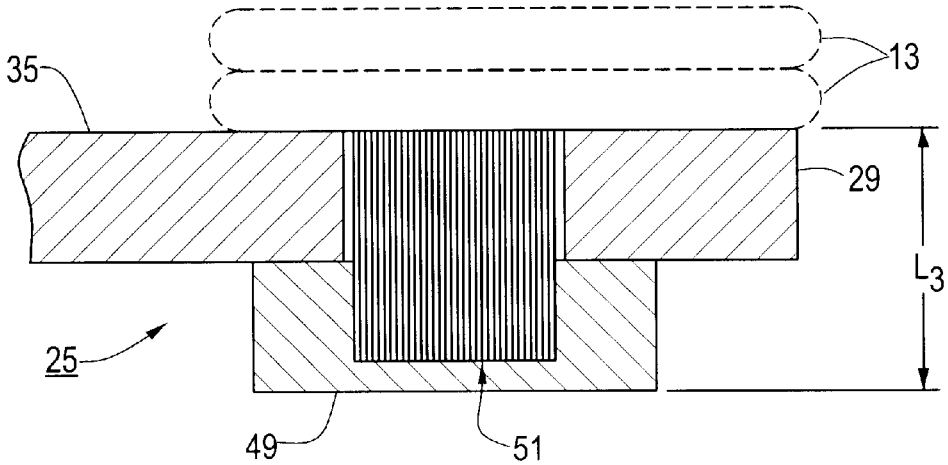
FIG. 3 is an enlarged, side section view of the reactor plate assembly shown FIG. 2, the reactor plate assembly being shown with a pair of socks in phantom positioned thereon for coupling.
Figure 6:
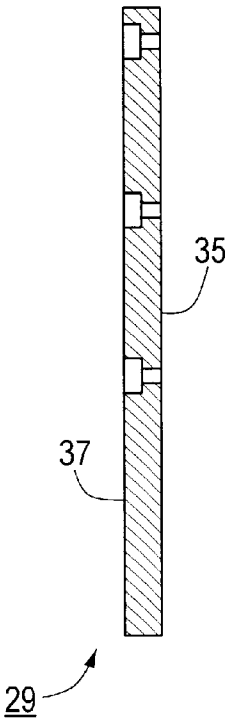
FIG. 6 is a side section view of the reactor plate shown in FIG. 5, taken along lines 6—6.

Referring now to FIG. 1, there is shown a side view of a device for dispensing plastic fasteners constructed in accordance with the principles of the present invention, the device being designated as reference numeral 11. As can be appreciated, device 11 can be used to sever individual plastic fasteners from continuously connected ladder stock and to dispense and attach such individual plastic fasteners to desired items, such as a pair of socks 13, as shown in FIG. 3

Device 11 comprises a frame 15 which includes a base 17, a neck 19, a housing 21 and an arm 23 onto which a reactor plate assembly 25 is mounted. Device 11 further comprises a hollow slotted needle 27 which is disposed within housing 21 and which is capable of vertical movement. Preferably, hollow slotted needle 27 has a diameter of approximately 0.085 inches.

It should be noted that, for simplicity and clarity, the particular components used to downwardly drive needle 27 do not directly pertain to the present invention and accordingly are not described in detail herein. However, it is to be understood that the severing and ejecting means described in U.S. Pat. No. 5,433,366, which is incorporated herein by reference, could be implemented into device 11.

It should also be noted that the novelty of the present invention lies in the particular construction of reactor plate assembly 25. As such, the remaining components of device 11 are not to be taken in a limiting sense. Rather, it is to be understood that the various changes could be made with regard to the remainder of device 11 without departing from the spirit of the present invention. For example, device 11 could alternatively comprise a pair of hollow slotted needles, rather than single hollow needle 27, without departing from the spirit of the present invention.

Figure 2:
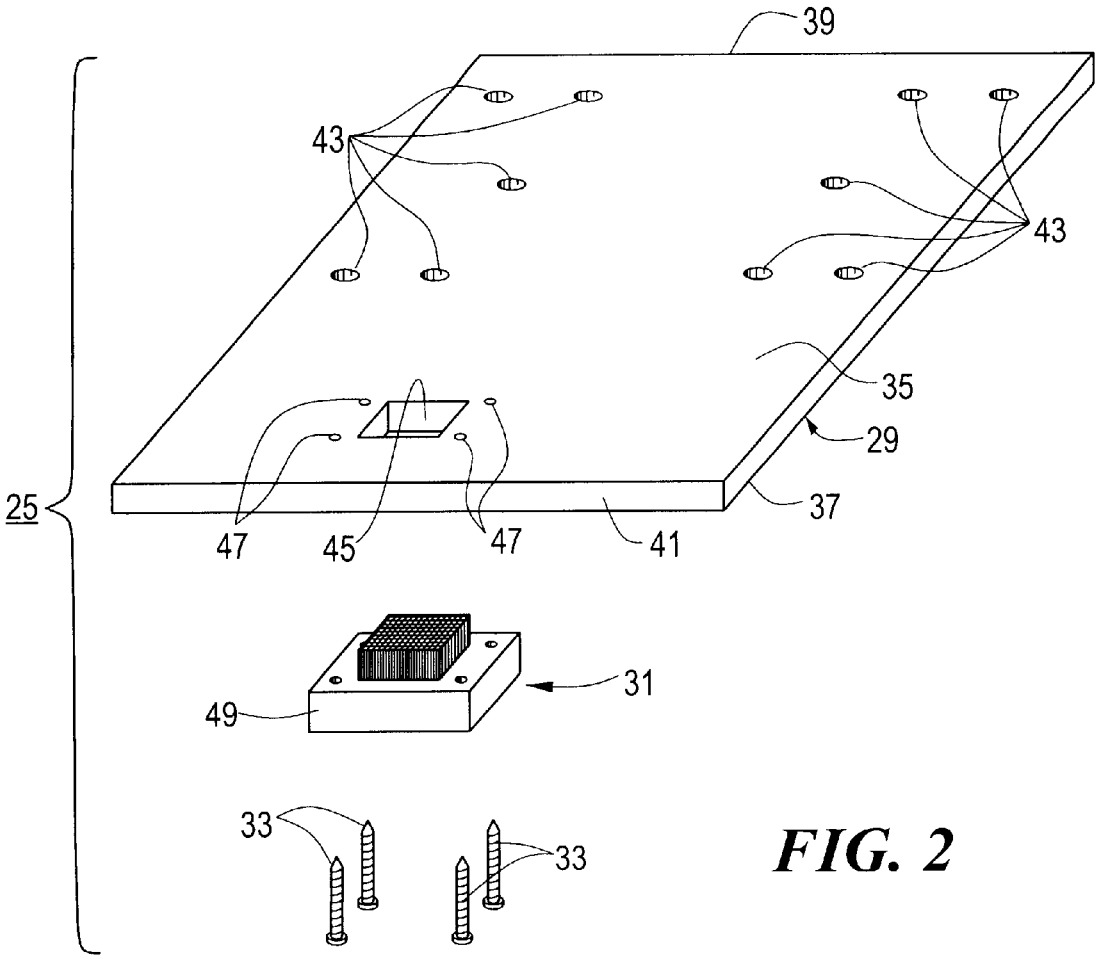
FIG. 2 is a top, exploded, perspective view of the reactor plate assembly shown in FIG. 1.

As shown in FIGS. 2 and 3, reactor plate assembly 25 comprises a reactor plate 29 and a brush assembly 31 which is mounted on reactor plate 29 by a plurality of screws 33. It is to be understood that brush assembly 31 is not limited to being mounted on reactor plate 29 by screws 33. Rather, brush assembly 31 could be mounted on reactor plate 29 by alternative securing devices, such as clamps or adhesives, without departing from the spirit of the present invention.

Reactor plate 29 is generally rectangular and is manufactured out of rigid and durable material, such as metal, plastic or any other suitable material. Reactor plate 29 comprises a top surface 35, a bottom surface 37, an inner end 39 and an outer end 41. Reactor plate 29 also comprises a plurality of reactor plate mounting holes 43 which extend therethrough. Mounting holes 43 are provided in reactor plate 29 to enable a securing device (not shown), such as a screw or bolt, to protrude through an associated mounting hole 43 in order to mount reactor plate 29 on arm 23.

Figure 5:
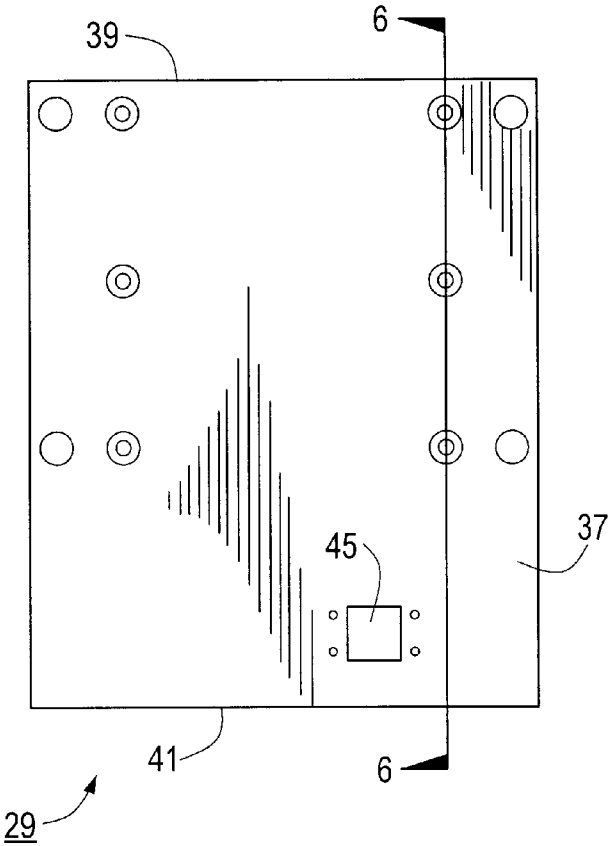
FIG. 5 is a bottom plan view of the reactor plate shown in FIG. 2.
Figure 4:
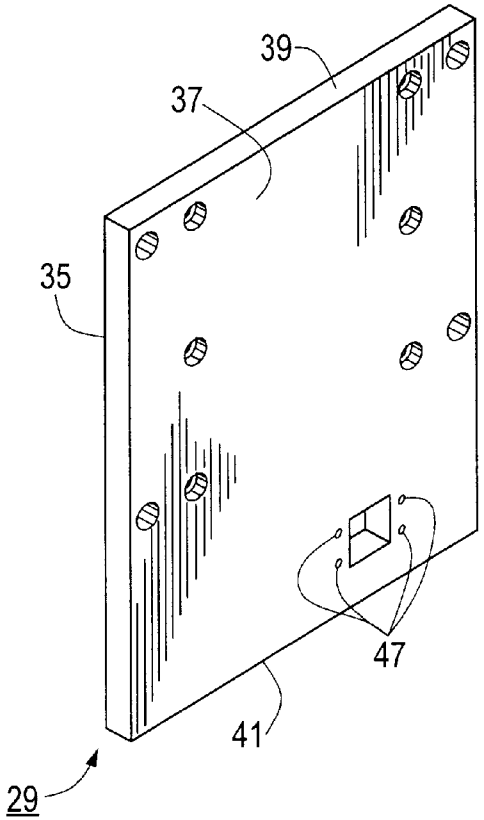
FIG. 4 is a bottom perspective view of the reactor plate shown in FIG. 2.

Reactor plate 29 further comprises a brush assembly opening 45 and a plurality of brush assembly mounting holes 47. Brush assembly opening 45 is located proximate outer end 41 and extends through reactor plate 29 from top surface 35 to bottom surface 37. Brush assembly opening 45 is generally rectangular in lateral cross-section, as shown in FIG. 5, and is sized and shaped to enable a portion of brush assembly 31 to protrude therein, as will be described further in detail below. Two brush assembly mounting holes 47 are disposed on opposite sides of brush assembly opening 45 and are threaded and sized to enable screws 33 to securely mount brush assembly 31 onto reactor plate 29, as will be described further in detail below.

Figure 7:
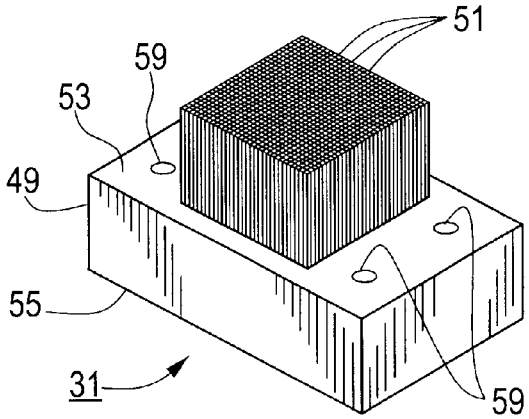
FIG. 7 is a top perspective view of the brush assembly shown in FIG. 2.
Figure 8:
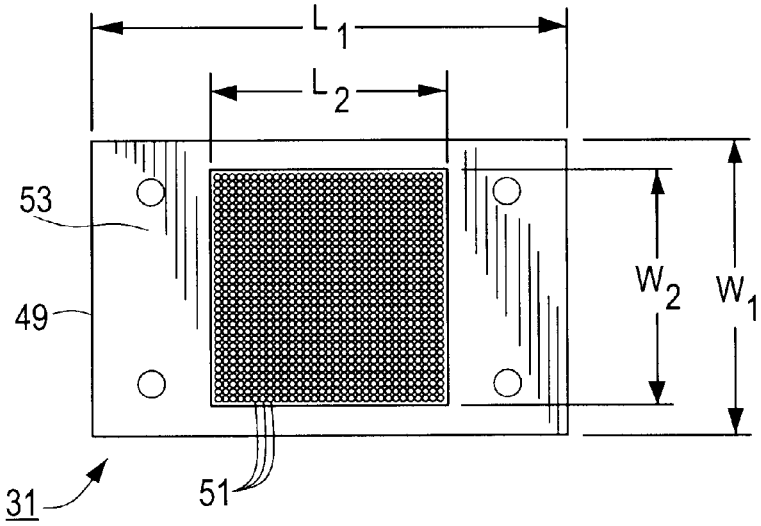
FIG. 8 is a top plan view of the brush assembly shown in FIG. 2.
Figure 9:
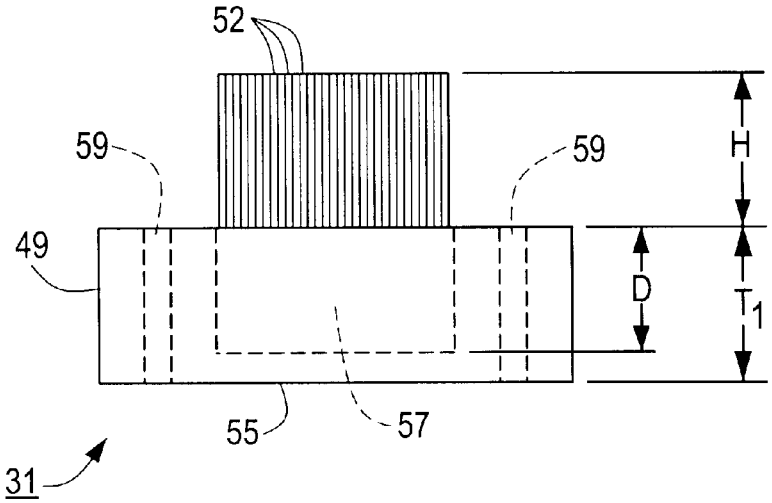
FIG. 9 is a side view of the brush assembly shown in FIG. 2.

Referring now to FIGS. 7–9, brush assembly 31 comprises a mounting block 49 and a plurality of brush filaments 51 coupled to and extending from mounting block 49, each brush filament having a free end 52.

Mounting block 49 comprises a top surface 53 and a bottom surface 55 and is preferably constructed out of high density polyethylene. However, it is to be understood that mounting block could be constructed out of alternative materials, such as different types of plastics, without departing from the spirit of the present invention. Mounting block 49 has a length $L_1$ of approximately 2 inches, a width $W_1$ of approximately 1.25 inches and a thickness $T_1$ of approximately 0.625 inches.

A recess 57 is formed in top surface 53 of mounting block 49. Recess 57 is generally rectangular in lateral cross-section and has a length $L_2$ of approximately 1 inch, a width $W_2$ of approximately 1 inch and a depth D of approximately 0.5 inches.

A portion of brush filaments 51 are disposed within recess 57 in mounting block 49 and are preferably held therein as a bundle by lining recess 57 with an adhesive, such as epoxy. The density of brush filaments 51 within recess 57 is preferably about 1500 brush filaments per square inch.

Each brush filament 51 preferably has a length $L_3$ of approximately 1.125 inches. Each brush filament is preferably circular in lateral cross-section with a diameter of approximately 0.022 inches. Brush filaments 51 are disposed within recess 57 so that a height H of approximately 0.625 inches of each filament 51 protrudes above top surface 53 of mounting block 49 and approximately 0.5 inches of each filament 51 is disposed within recess 57 of mounting block 49. In addition, brush filaments 51 are disposed within recess 57 so that adjacent filaments 51 are spaced approximately 0.007 inches apart.

Filaments 51 are preferably manufactured out of a strong and flexible material, such as nylon. It should be noted that the particular material used for each brush filament 51 enables brush filaments 51 to bend or attenuate upon the application of a downward force directly on free end 52. Due to its resiliency, brush filaments return to its original shape upon the removal of the downward force. Furthermore, it should be noted that providing a high density of filaments 51 in a relatively small area creates a strong support surface, or anvil, for device 11, which is an object of the present invention.

Brush assembly 31 is mounted onto bottom surface 37 of reactor plate 29 so that brush filaments 51 protrude into brush assembly opening 45. As shown in FIG. 3, brush filaments 51 protrude into opening 45 in such a manner so that free end 52 of filaments 51 are flush with top surface 35 of reactor plate 29, thereby creating a flat support surface, or anvil. Brush assembly 31 is retained in its mounted position on reactor plate 29 by screws 33. Specifically, screws 33 project through associated holes 59 formed in mounting block 49 and into brush assembly mounting holes 47 in reactor plate 29.

In use, reactor plate assembly 25 serves as a support surface, or anvil, for plastic fastener dispensing device 11. It should be noted that the high density of filaments 51, approximately 1500 filaments per square inch, provides a strong support surface for reactor plate assembly 25. Furthermore, it should be noted that, as needle 27 pierces through the items to be coupled, the ability of filaments 51 to bend ensures that needle 27 projects down between filaments 51. Specifically, device 11 downwardly urges needle 27 with approximately 30 pounds of force. As a result, if needle 27 projects down directly onto free end 52 of an individual filament 51, free end 27 having a diameter of approximately 0.022 inches, the downward force of needle 27 will bend and laterally displace the individual filament 51 a distance so that needle 27, which has a diameter of approximately 0.085 inches, will be able to protrude down between the bundle of filaments 51, adjacent unbent filaments 51 being spaced apart approximately 0.007 inches. It should also be noted that needle 27 creates a space between adjacent filaments 51, which are normally spaced apart approximately 0.007 inches, a large enough distance so that the cross-bar, also commonly referred to as a T-bar, of an individual fastener will be able to protrude out from needle 27 and slide out from between filaments 51 without engaging any individual filament 51, the cross-bar of an individual fastener preferably having a diameter of approximately 0.030 inches.

The embodiment shown in the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A reactor plate assembly for a device for dispensing plastic fasteners, said reactor plate assembly comprising:

a reactor plate having a top surface, a bottom surface and an opening therethrough, and a brush assembly mounted on said reactor plate.

2. The reactor plate assembly of claim 1 wherein said brush assembly comprises a mounting block and a plurality of brush filaments coupled to and extending out from the mounting block.

3. The reactor plate assembly of claim 2 wherein the brush assembly is mounted on the bottom surface of said reactor plate.

4. The reactor plate assembly of claim 3 wherein the brush assembly is mounted on the bottom surface of said reactor plate so that a portion of the plurality of filaments protrudes into the opening in said reactor plate.

5. The reactor plate assembly of claim 4 wherein the mounting block comprises a top surface, a bottom surface and a recess formed in the top surface.

6. The reactor plate assembly of claim 5 wherein a portion of the plurality of brush filaments are disposed within the recess formed in the top surface of the mounting block.

7. The reactor plate assembly of claim 6 wherein each of the plurality of brush filaments comprise a free end.

8. The reactor plate assembly of claim 7 wherein the brush assembly is mounted on the bottom surface of said reactor plate so that the free end of each of said plurality of filaments is flush with the top surface of said reactor plate.

* * * * *